US010092064B2

(12) United States Patent
Ringholz et al.

(10) Patent No.: US 10,092,064 B2
(45) Date of Patent: Oct. 9, 2018

(54) INSOLE WITH SUSPENDED MESH SURFACE

(71) Applicant: Plae, Inc., San Francisco, CA (US)

(72) Inventors: Ryan Ringholz, Mill Valley, CA (US); Hung-Chia Lin, Tainan (TW)

(73) Assignee: PLAE, INC., San Francisco, CA (US)

( * ) Notice: Subject to any disclaimer, the term of this patent is extended or adjusted under 35 U.S.C. 154(b) by 0 days.

(21) Appl. No.: 15/442,081

(22) Filed: Feb. 24, 2017

(65) Prior Publication Data

US 2017/0245591 A1 Aug. 31, 2017

Related U.S. Application Data

(60) Provisional application No. 62/299,587, filed on Feb. 25, 2016.

(51) Int. Cl.

| | |
|---|---|
| ***A43B 13/38*** | (2006.01) |
| ***A43B 17/02*** | (2006.01) |
| ***A43B 17/10*** | (2006.01) |
| ***A43B 1/04*** | (2006.01) |
| ***A43B 13/40*** | (2006.01) |
| ***A43B 17/00*** | (2006.01) |
| ***A43B 17/14*** | (2006.01) |

(52) U.S. Cl.

CPC ..... *A43B 17/02* (2013.01); *A43B 1/04* (2013.01); *A43B 13/386* (2013.01); *A43B 13/40* (2013.01); *A43B 17/006* (2013.01); *A43B 17/10* (2013.01); *A43B 17/102* (2013.01); *A43B 17/14* (2013.01)

(58) Field of Classification Search

CPC ..... A43B 17/10; A43B 17/102; A43B 17/02; A43B 17/14; A43B 13/386; A43B 13/40

USPC ..... 36/43, 44, 165, 3 B

See application file for complete search history.

(56) References Cited

U.S. PATENT DOCUMENTS

| | | | | | |
|---|---|---|---|---|---|
| 1,880,654 | A | * | 10/1932 | Baird | A43B 7/1415 36/165 |
| 2,119,850 | A | * | 6/1938 | Bauer | A43B 7/142 36/165 |
| 2,662,309 | A | * | 12/1953 | Morton | A43B 7/142 36/165 |
| 2,812,570 | A | * | 11/1957 | Petersilie | A43B 7/141 139/425 R |
| 2,917,844 | A | * | 12/1959 | Scholl | A43B 7/142 36/165 |
| 2,917,848 | A | * | 12/1959 | Scholl | A43B 7/141 36/165 |

(Continued)

OTHER PUBLICATIONS

International Search Report and Written Opinion issued by the U.S. Patent and Trademark Office as International Searching Authority, issued in International Application No. PCT/US2017/019450, dated May 4, 2017 (8 pages).

*Primary Examiner* — Ted Kavanaugh

(74) *Attorney, Agent, or Firm* — Wilmer Cutler Pickering Hale and Dorr LLP

(57) ABSTRACT

An insole is provided that is constructed out of a mesh material that is stretched and suspended over a cavity formed in a shoe. The mesh surrounds a foam base and a rigid frame positioned under the foam base. The foam base is shaped so that a cavity is formed between the top surface of the foam base and the mesh positioned over the foam base to provide a "trampoline" effect for a wearer's foot.

8 Claims, 10 Drawing Sheets

(56) References Cited

U.S. PATENT DOCUMENTS

| | | | | |
|---|---|---|---|---|
| 3,170,178 | A * | 2/1965 | Scholl | A43B 7/1415<br>12/142 R |
| 5,561,920 | A | 10/1996 | Graham et al. | |
| 5,680,714 | A | 10/1997 | Lopez | |
| 5,974,695 | A | 11/1999 | Slepian et al. | |
| 2006/0277696 | A1 | 12/2006 | Kendall | |

* cited by examiner

INSOLE WITH SUSPENDED MESH SURFACE

CROSS-REFERENCE TO RELATED APPLICATIONS

This application relates to and claims priority under U.S.C. § 119(e) to U.S. Provisional Patent Application No. 62/299587, titled "INSOLE WITH SUSPENDED MESH SURFACE," which was filed on Feb. 25, 2016 and is hereby incorporated by reference in its entirety.

BACKGROUND OF THE INVENTION

Traditional insoles for footwear are made out of a compression material such as foam. While foam offers some comfort level to a wearer's foot, it generally does not conform to the entire foot of the wearer and will therefore support only certain pressure points. As a result, users often have trouble finding shoes that are consistently comfortable for the user, as certain traditional insoles will fit better for some users then others.

Another downside of foam insoles is that sweat from the foot tends to collect on the foam as it does not allow for the circulation of air around the foot.

It is therefore the principal object of the present invention to produce an insole, which provides a customized fit for all wearers.

It is another object for the present invention to provide an insole, which provides for a reduction in sweat buildup on the insole.

SUMMARY OF THE INVENTION

An insole is provided that is constructed out of a mesh material that is stretched and suspended over a cavity formed in a shoe. The mesh surrounds a foam base and a rigid frame positioned under the foam base. The foam base is shaped so that a cavity is formed between the top surface of the foam base and the mesh positioned over the foam base to provide a "trampoline" effect for a wearer's foot.

In another embodiment the mesh material is secured to the upper of a shoe. The interior of the sole of the shoe is shaped to form a cavity between the mesh layer and a foam layer in the sole of the shoe so that when the upper is secured to the sole the wearer of the shoe can experience the "trampoline" effect.

These and other features and objects of the present invention will be more fully from the following detailed description which should be read in light of the accompanying drawings in which corresponding reference numerals refer to corresponding parts throughout the several views.

DETAILED DESCRIPTION

Figure 1:
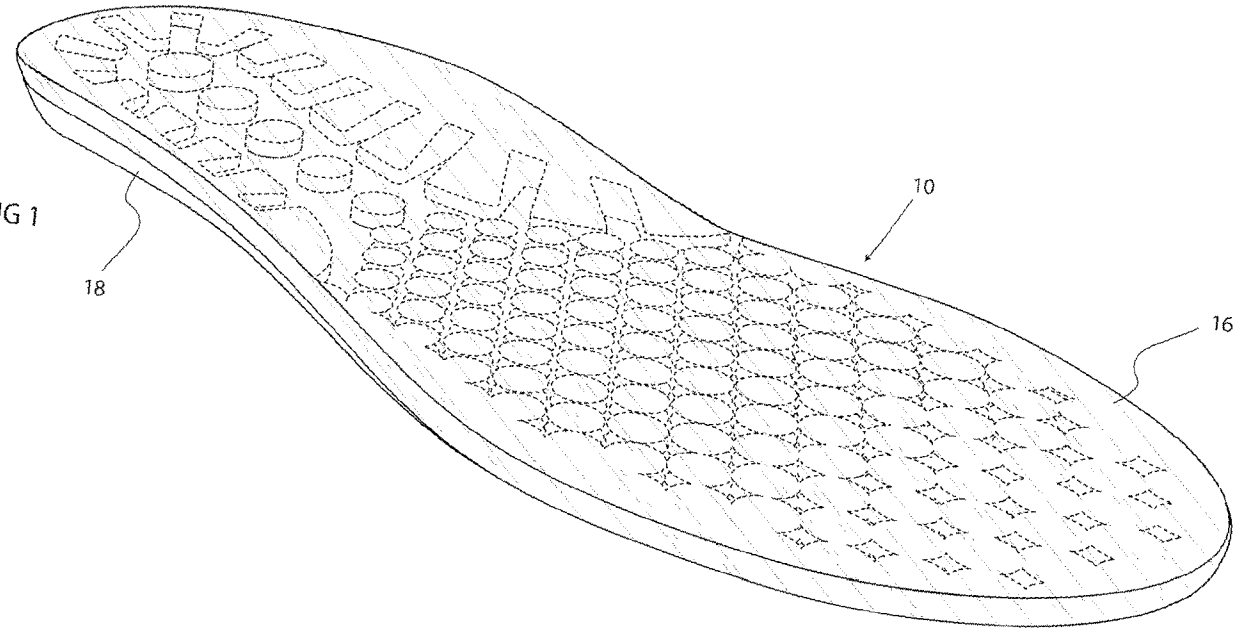
FIG. 1 is a top perspective view of an insole of the present invention.
Figure 2:
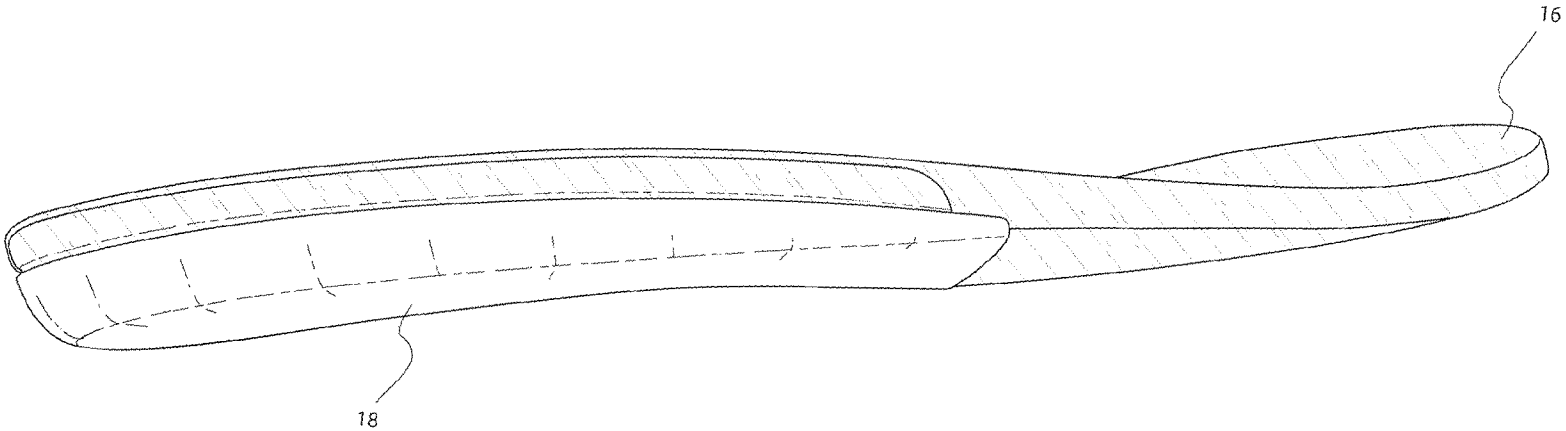
FIG. 2 is a side perspective view of an insole shown in FIG. 1.
Figures 3, 4, 5, 6:
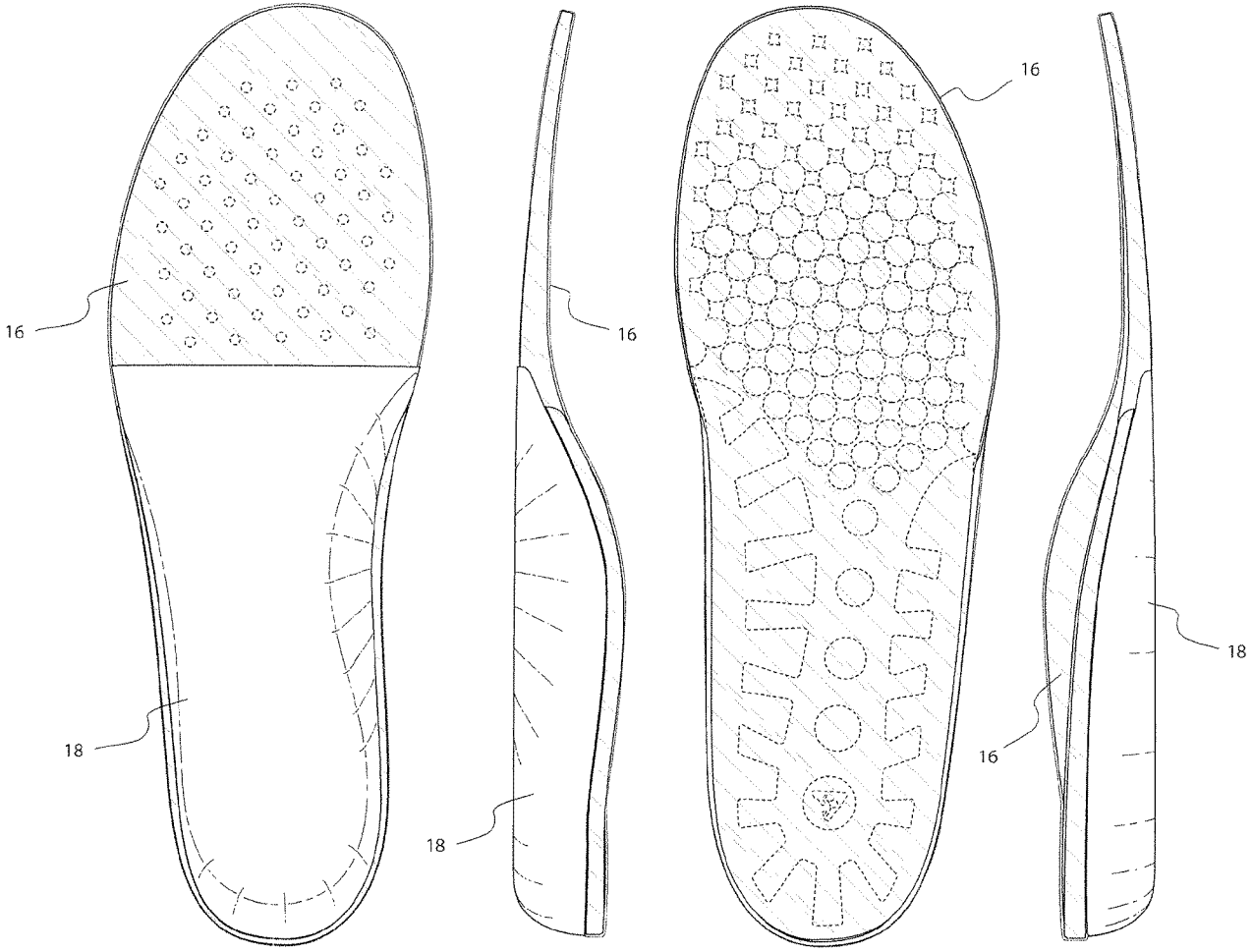
FIG. 3 is a bottom view of the insole shown in FIG. 1.
FIG. 4 is a medial side view of the insole shown in FIG. 1.
FIG. 5 is a top view of the insole shown in FIG. 1.
FIG. 6 is a lateral side view of the insole shown in FIG. 1.
Figure 7:
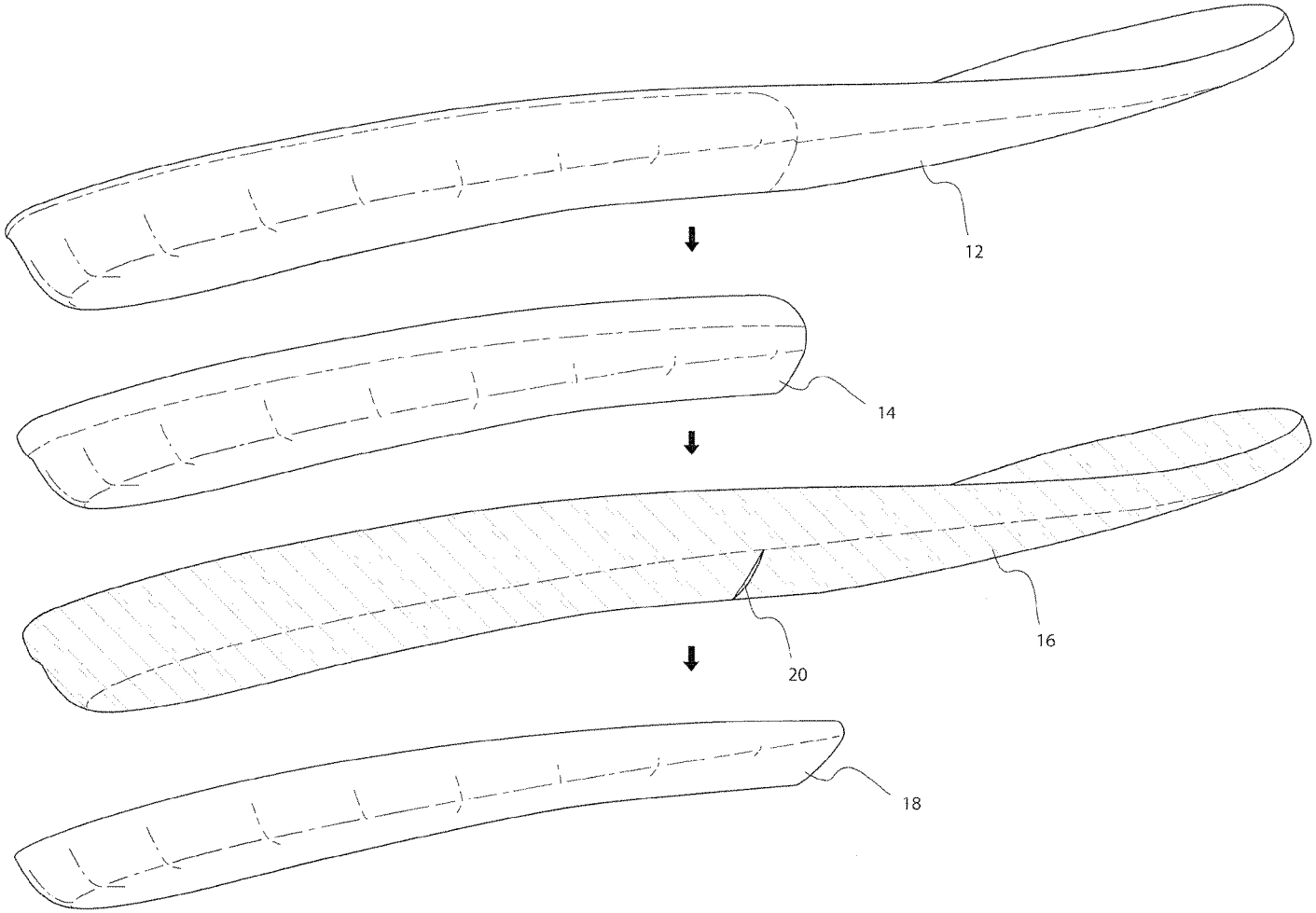
FIG. 7 is an exploded view showing the components of the insole shown in FIG. 1.
Figure 8:
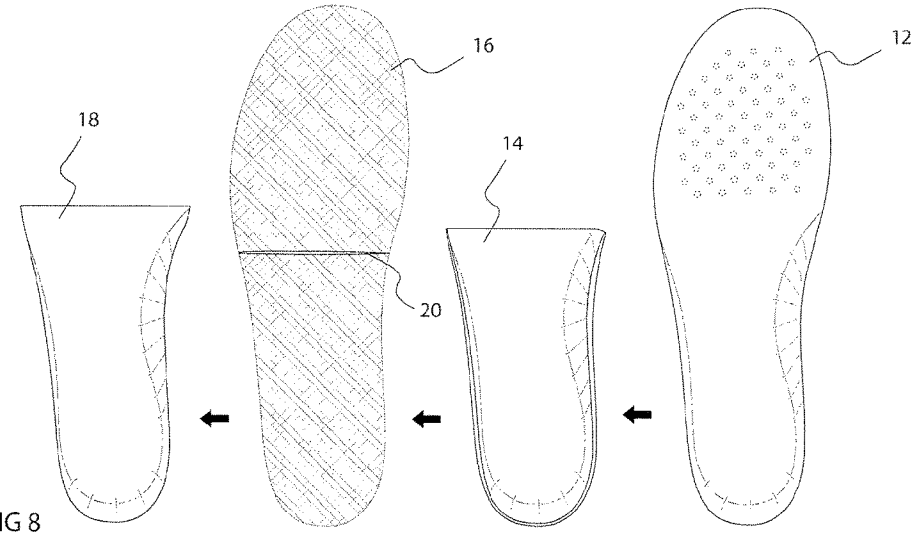
FIG. 8 is a bottom view of all the components of the insole shown in FIG. 1.
Figure 9:
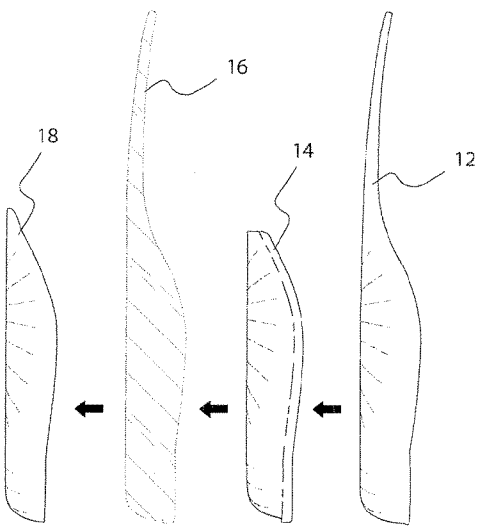
FIG. 9 is a medial side view of the components of the insole shown in FIG. 8.
Figure 10:
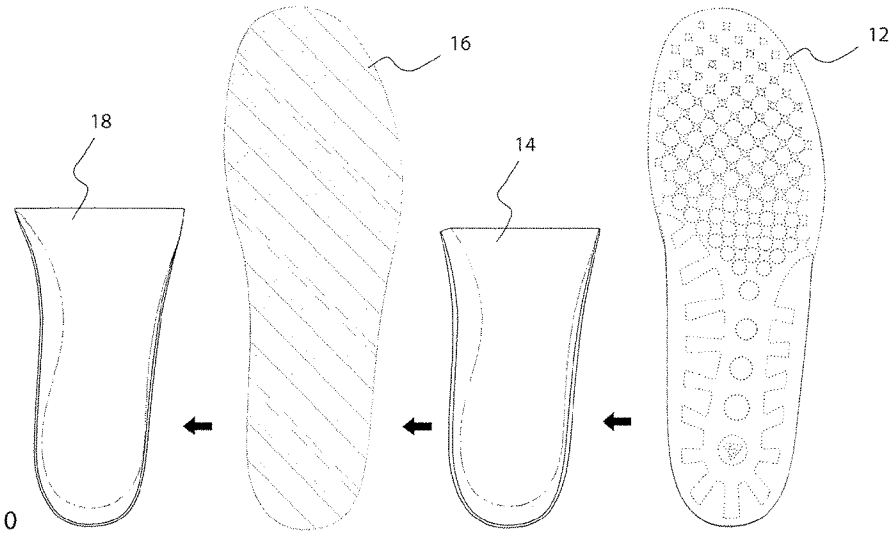
FIG. 10 is a top view of the components of the insole shown in FIG. 8.
Figure 11:
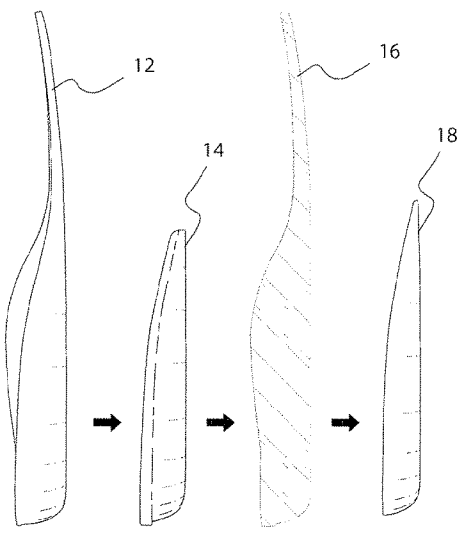
FIG. 11 is a lateral view of the components of the insole shown in FIG. 8.

Referring to FIGS. 1-14, insole 10 of the present invention includes a foam base 12, which is preferably made out of polyurethane or ethylene vinyl acetate (EVA). A rigid frame 14 is positioned under the foam base 12, and the foam base 12 and rigid frame 14 are inserted into a suspension mesh enclosure 16. Rigid frame 14 provides the structure necessary to create tension on the suspension mesh when placed in the suspension mesh enclosure 16. In a preferred embodiment, the rigid frame 14 is constructed out of nylon or carbon fiber. The suspension mesh enclosure 16 is shown as a pre-sewn enclosure or "glove" whereby the foam base 12 and rigid frame 14 are preassembled and then pressure fit into the mesh "glove" 16 which is made up of a suspension mesh. The suspension mesh enclosure 16 includes a slit opening 20 through which the pre-assembled foam base 12 and rigid frame 14 are pressure fit.

A secure cover 18 is positioned under the suspension mesh enclosure 16. The secure cover 18 provides two functions. A structurally secure cover 18 ensures that the "glove" components do not shift and move after the suspension mesh enclosure 16 is pressure fit over the preassembled foam base 12 and rigid frame 14. The secure cover 18 also conceals stitching of the "glove" construction and the split opening 20 of the suspension mesh enclosure 16.

Figure 12:
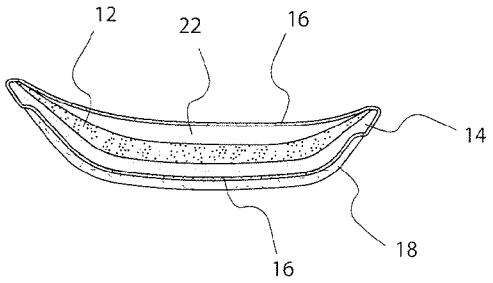
FIG. 12 is a cross section of the components of the insole shown in FIG. 1 taken across the width of the insole.
Figure 13:
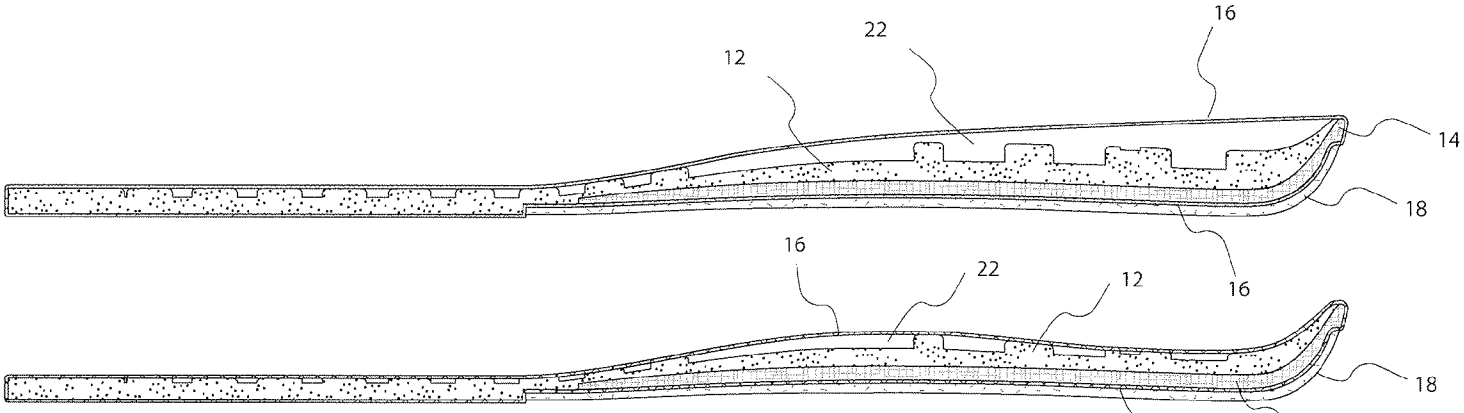
FIG. 13 is a cross section of the components of the insole shown in FIG. 1 taken along the length of the insole when the insole is not in use.
Figure 14:
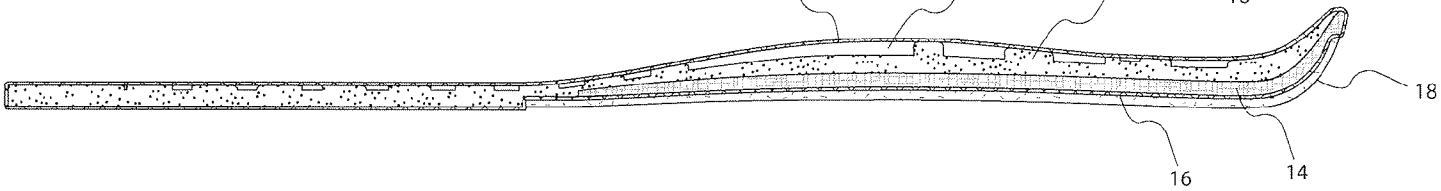
FIG. 14 is a cross section of the components of the insole shown in FIG. 1 taken along the length of the insole when the insole is in use.
Figure 15:
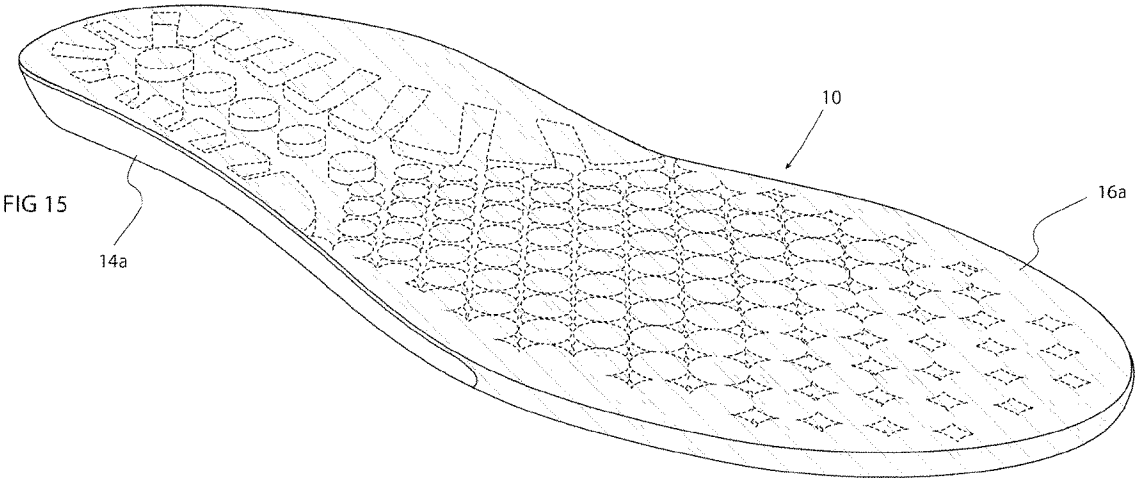
FIG. 15 is a top perspective view of an insole of the present invention in which the rigid frame and suspension mesh enclosure are co-molded.
Figure 16:
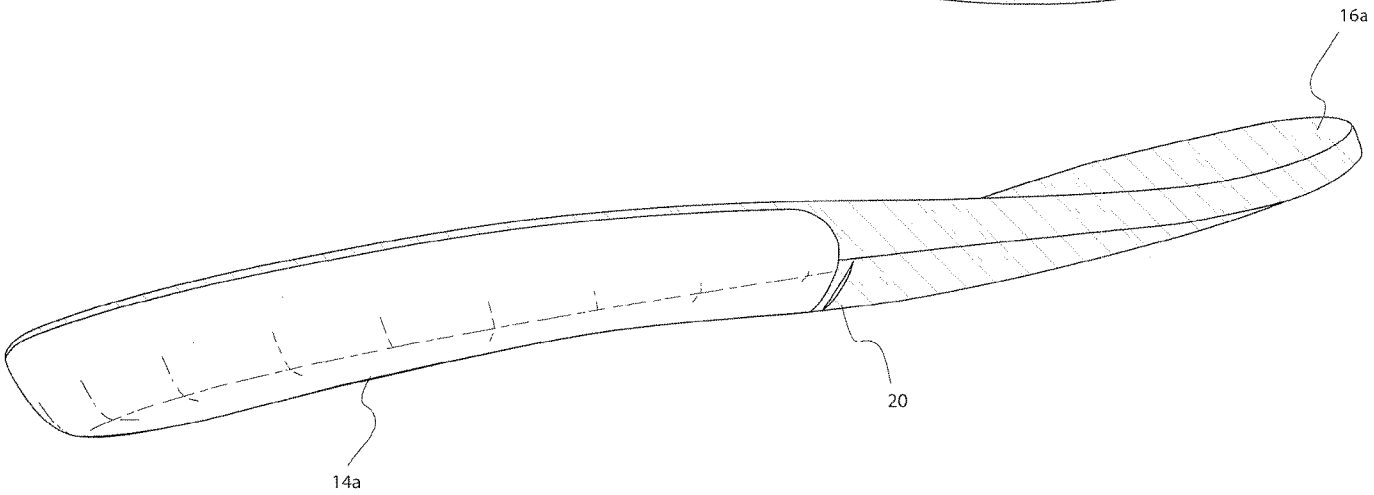
FIG. 16 is a side perspective view of an insole shown in FIG. 15.
Figure 17:
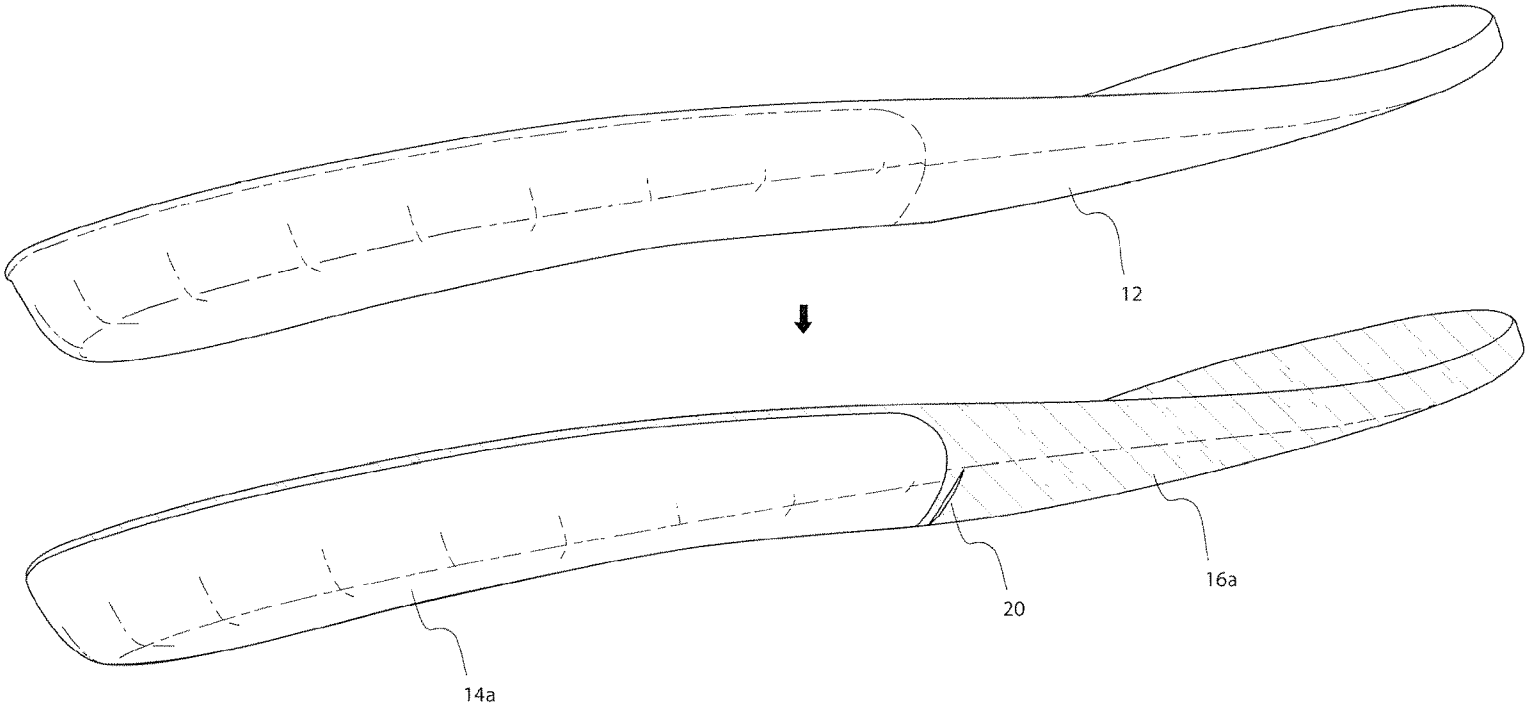
FIG. 17 is an exploded view showing the components of the insole shown in FIG. 15.
Figure 18:
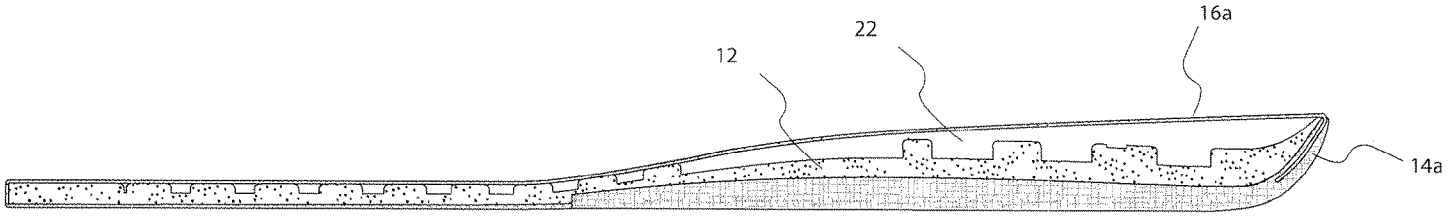
FIG. 18 is a cross section of the components of the insole shown in FIG. 15 taken along the length of the insole when the insole is not in use.
Figure 20:
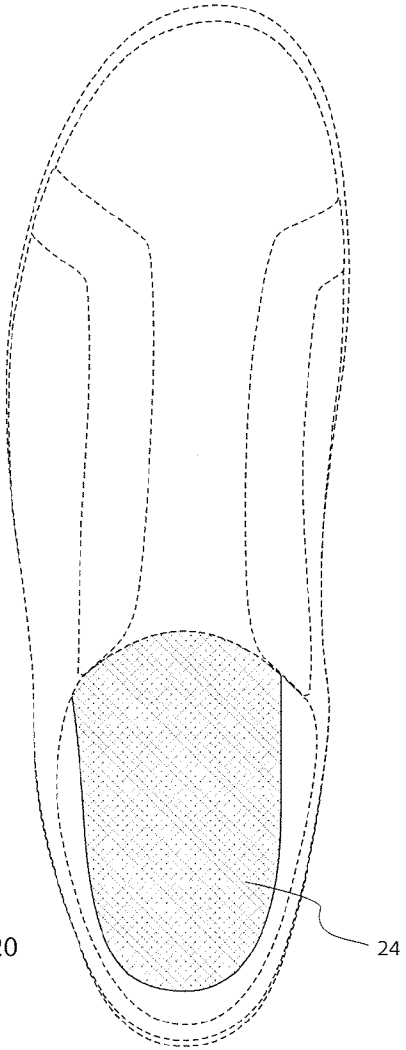
FIG. 20 is a top view of a mesh-lasted upper shown in FIG. 19.
Figure 19:
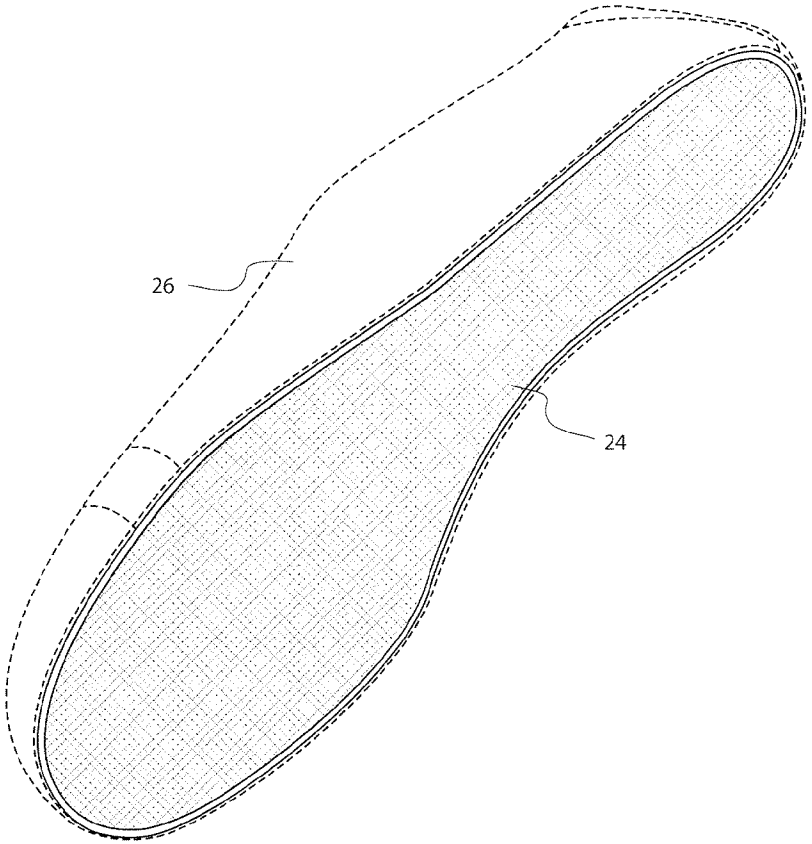
FIG. 19 is a perspective view the bottom of a mesh-lasted upper.

Referring to FIGS. 12-14, the cross-sectional view of the insole 10 shows the suspension mesh layer 16 being supported above the rigid frame 14 and foam base 12. Due to the rigid construction of frame 14, the mesh is suspended above the top surface of the foam base 12 to create an air channel 22 between the top of the suspension mesh enclosure 16 and the foam base 12. As a result, this mesh provides a trampoline fit which enables ambient air to pass between the suspension mesh layer 16 and top surface of the foam base 12.

The construction of the insole 10 of the present invention described above provides two key advantages for the wearer. First, the mesh of the suspension mesh enclosure 16 provides a customized fit as it will warp to follow the contour of the wearer's foot, yielding to pressure points and giving support to the wearer, where uniquely needed. It has the effect similar to that of standing on a trampoline where the suspension mesh enclosure 16 will conform around the unique topography of an individual foot as shown in FIG. 14. Second, when the foot is lifted, the suspended mesh enclosure 16 rebounds and allows for ambient airflow below the foot, which helps, insulate the foot and prevent moisture buildup from sweat as shown in FIGS. 12 and 13. This is a significant advantage over other solutions that simply perforate a traditional compression foot bed, whereby the foot remains in contact with the majority of the foot bed at all times.

In an alternate embodiment shown in FIGS. 15-18, the suspension mesh 16*a* is co-molded with the rigid frame 14*a*, thereby eliminating the need for the "glove" construction. In such an alternate embodiment, the secure cover 18 would be optional as the suspension mesh enclosure 16 and rigid frame 14 are co-molded thereby being innately secured and aesthetically provided with a clean look. In such a case only the foam base 12 would need to be inserted into the mesh enclosure 16*a*.

While a variety of types of mesh could be utilized in the present invention, in one preferred embodiment, a static mesh is utilized. Static mesh is particularly well-suited because the focus point of impact (which is at the bottom of the foot) exerts increased tension on the mesh. In addition, the space allotted for vertical give of the mesh in the construction of the insole, is limited by the interior volume of the shoe, as well as toe to heel lift, which in most cases is a maximum of 15 mm. The rigid frame 14 itself also has an inherent amount of give, depending upon design of the frame (sidewall angles and contours) as well as the durometer and material composition of the frame. Control over the give of the mesh layer (if necessary) can then be achieved by changing the design of the frame and material composition.

In a preferred embodiment, the mesh is pulled as taught as the material properties will allow without compromising the structural integrity of these materials. In one preferred embodiment, the mesh material is made of polyester in longer fibers. Such longer fibers, which are also known as continuous fibers, have a general aspect ratio (defined as the ratio of fiber length to diameter) of between 200 and 500. The longer fiber is essential in that it can withstand the pull strength.

In one embodiment, the mesh is made from a strong breathable mesh sold by Chang Sing Co. Ltd. under the fabric code CS366. Such a mesh is knitted on a Tricot-machine made in Germany and sold by Liebers. The fiber that is used in the mesh is a 150 den/48 filament (50% trilobal shiny yarn and 50% semi-dull yarn). This yarn, which is referred to as a virgin polyester yarn, can be obtained from Nanya Plastics Corporation. Of course many other mesh materials can be used if they display similar properties.

In another embodiment, the mesh is knit on a CNC Knitting Machine (such as Stoll v-bed weft-knitting machine) of multiple interconnected layers within a single seamless textile, often referred to as 3D knitting or shaping. With the additional ability to utilize multiple yarns ranging in quality from elastic to structural, the CNC Knitting Machine allows for the production of textiles with great degrees of differentiation in material characteristics and geometry to accommodate infinite adjustability and personal customization for the wearer (for example, if a wearer requires greater support on the medial side of the foot to offset pronation, the suspension mesh may be knit with a static thread and dense geometry on the medial side of the heel).

Turning now to FIGS. 19-22, another alternate embodiment of the present invention is shown in which the mesh 24 is used in place of a traditional lasting board and the upper 26 is mated to the sole with a cavity allowing for the mesh 24 to give. This provides the same advantage as described above with the mesh being fitted over the foam base 12 and a rigid frame 14. One advantage of this alternate construction shown in FIGS. 19-22 is that in this case the mesh 24 is fixed.

Figure 21:
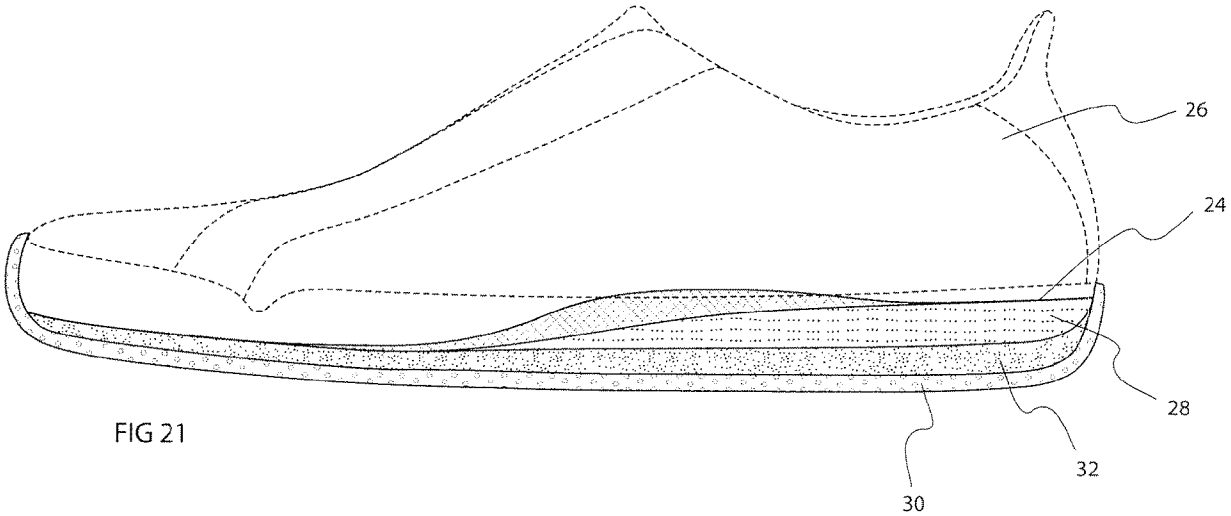
FIG. 21 is a cut-away side view of the mesh-lasted upper shown in FIG. 19.
Figure 22:
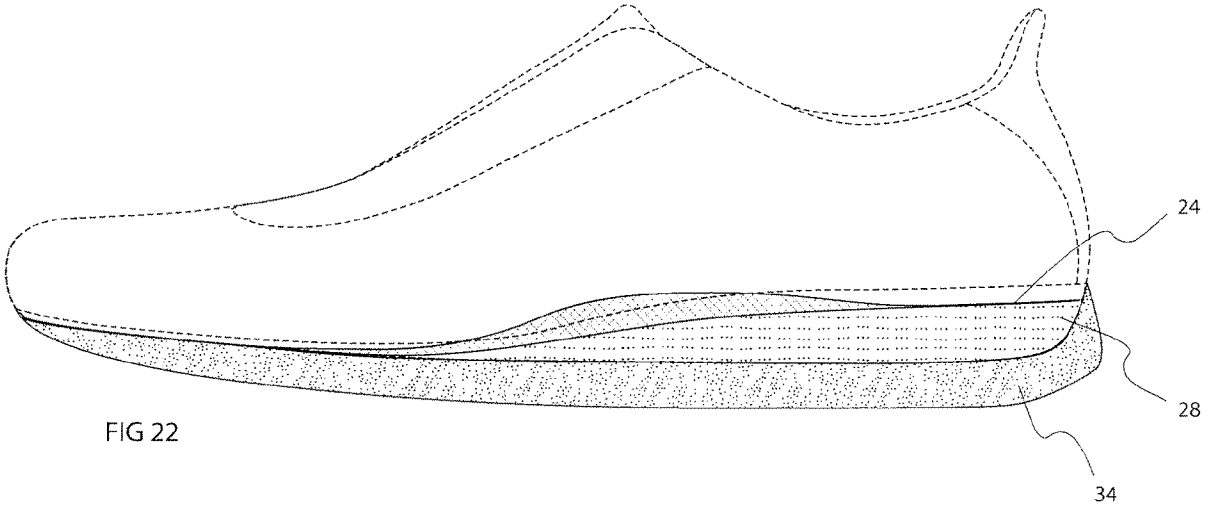
FIG. 22 is an alternate cut-away side view of the mesh-lasted upper shown in FIG. 19.

In the embodiment of FIG. 21, the mesh 24 is suspended over an open cavity 28 in the sole 30 between the mesh and the foam cushioning 32. The foam cushioning 32 is inlaid in the sole to provide protection should the mesh bottom out on impact. In the alternate embodiment shown in FIG. 22, the cavity is created in the mid-sole foam 34.

A CNC Knitting Machine (described above) may also be used to produce the upper 26 and mesh lasting board 24 combined as a single 3D knit seamless textile part.

While the foregoing invention has been described with reference to its preferred embodiments, various alterations and modifications will occur to those skilled in the art. All such alterations and modifications are intended to fall within the scope of the appended claims.

What is claimed is:

1. An insole for a shoe comprising:

a suspension mesh enclosure;

a foam base inserted in said suspension mesh enclosure;

a rigid frame for supporting said foam base, said rigid base being in contact with said suspension mesh enclosure to provide tension on the mesh of said suspension mesh enclosure;

wherein said foam base is shaped to create a cavity between a top surface of said foam base and the interior surface of said suspension mesh enclosure adjacent said top surface of said foam base.

2. The insole for a shoe of claim 1 wherein said suspension mesh enclosure further comprises at least one slit through a surface of said mesh enclosure through which said foam base may be inserted.

3. The insole for a shoe of claim 1 wherein said rigid frame is inserted in said suspension mesh enclosure.

4. The insole for a shoe of claim 1 wherein said rigid frame and suspension mesh enclosure are co-molded.

5. The insole for a shoe of claim 1 wherein said mesh of said suspension mesh is breathable mesh manufactured out of a polyester yarn in longer fibers having a general aspect ratio (defined as the ratio of fiber length to diameter) of between 200 and 500.

6. The insole for a shoe of claim 1 further comprising a secure cover positioned under the suspension mesh enclosure.

7. The insole for a shoe of claim 1 wherein said mesh further comprises multiple interconnected layers within a single seamless textile.

8. The insole for a shoe of claim 1 wherein said layers include multiple different yarns ranging in quality from elastic to structural to provide adjustability and personal customization of said insole.

* * * * *